US011897663B2

(12) United States Patent
Graux

(10) Patent No.: US 11,897,663 B2
(45) Date of Patent: Feb. 13, 2024

(54) STOPPER HAVING A TAMPER-EVIDENT FEATURE

(71) Applicant: NOVEMBAL USA INC., Edison, NJ (US)

(72) Inventor: Stéphane Graux, Liergues (FR)

(73) Assignee: NOVEMBAL USA INC.

( * ) Notice: Subject to any disclaimer, the term of this patent is extended or adjusted under 35 U.S.C. 154(b) by 0 days.

(21) Appl. No.: 17/776,775

(22) PCT Filed: Nov. 12, 2020

(86) PCT No.: PCT/IB2020/060651

§ 371 (c)(1),
(2) Date: May 13, 2022

(87) PCT Pub. No.: WO2021/094968

PCT Pub. Date: May 20, 2021

(65) Prior Publication Data

US 2022/0396400 A1 Dec. 15, 2022

Related U.S. Application Data

(60) Provisional application No. 62/936,398, filed on Nov. 16, 2019.

(51) Int. Cl.
*B65D 41/48* (2006.01)
*B65D 55/16* (2006.01)

(52) U.S. Cl.
CPC ..... *B65D 41/485* (2013.01); *B65D 55/16* (2013.01)

(58) Field of Classification Search
CPC .. B65D 41/485; B65D 55/16; B65D 41/3428; B65D 41/3423; B65D 2401/40; B65D 41/3447
See application file for complete search history.

(56) References Cited

U.S. PATENT DOCUMENTS 3,990,598 A * 11/1976 Zapp ..... B65D 55/16 215/320
4,557,393 A 12/1985 Boik
5,056,675 A * 10/1991 Julian ..... B65D 55/16 215/252
6,299,005 B1 10/2001 Higgins
2004/0245206 A1 12/2004 Antier et al.
2006/0091100 A1 5/2006 Geho
2015/0251827 A1 9/2015 Campbell
(Continued)

OTHER PUBLICATIONS

International search report dated Apr. 21, 2021.

*Primary Examiner* — Shawn M Braden

(57) ABSTRACT

The invention includes a snap type plastic stopper having a closure shell with a roof wall and a tamper band to be secured on a bottle neck. The stopper includes a first weakness line with first bridges, where the first bridges separably link the bottom edge of the closure shell and the top edge of the tamper band; at least one hinge which extends through the first weakness line, where the hinge pivotably links the closure shell and the tamper band; and a tongue which is diametrically situated at the opposite of the hinge, where the tongue outwardly extends relative to a peripheral wall of the closure shell. The stopper also includes within the closure shell and/or tamper band at least one tamper evident feature such as a toggle.

18 Claims, 11 Drawing Sheets

(56) References Cited

U.S. PATENT DOCUMENTS

| | | | | |
|---|---|---|---|---|
| 2016/0016703 | A1* | 1/2016 | Mühlemann | B65D 41/62<br>222/566 |
| 2018/0086510 | A1 | 3/2018 | Betapack | |
| 2020/0156829 | A1* | 5/2020 | Pristera | B65D 41/3428 |
| 2020/0377268 | A1* | 12/2020 | Naumann | B65D 50/00 |

* cited by examiner

STOPPER HAVING A TAMPER-EVIDENT FEATURE

FIELD OF INVENTION

The present invention relates to a snap type plastic stopper for bottle. Specifically, the invention relates to a plastic stopper of a snap type, which comprises a roof linked to the closure shell through a hinge.

TECHNICAL FIELD

The present invention relates to the field of packaging, wherein it is very common to seal the aperture of a container with a stopper such as a closure or cap.

Such container is an individual object. The container is usually made of plastic, glass or metal material. The container can be a bottle filled with a fluid or a liquid, especially of a food or a cosmetic product.

The stopper can be made of metal or plastic material. A plastic stopper is mainly obtained through a molding process.

Such stoppers generally have a tubular or cylindrical shaped body closed at its top edge by a roof wall. The stopper body includes a closure shell attached at a bottom edge to a tamper band (so called "tamper evident ring") through a weakness line. Such weakness line is made of bridges, distributed around the closure shell and the tamper band. So the bridges link the closure shell and the tamper band together. Moreover the bridges are made when molding the stopper or after molding through a cutting step.

In order to engage the stopper to seal the container, the stopper neck includes one or more outer fixation features, such as thread(s) for screw type stopper or annular fixation rings for snap type stopper.

In conventional screw-type stoppers, the closure shell comprises inner thread(s) arranged inside side walls. The container neck fixation feature comprises outer thread(s). Such combination of outer and inner thread(s) allows the stopper to be screwed on the container neck to seal said container and unscrewed for container entirely opening.

In conventional snap-type stoppers include an inner annular area and the container neck fixation feature comprises outer fixation ring, in order to slot in force the stopper on the container neck. Moreover, a snap-type stopper comprises a closure shell with a sealing roof movable from a closure position to a part opening, and reversely. The roof may be separated upon opening or may be connected with the closure shell through a hinge.

Usually, the closure shell is removable. During container or bottle opening, the bridges of the weakness line are torn apart from the closure shell, so it is separated from the bottle. After opening, the closure shell can stay attached to the tamper band secured on the container neck through a link: such stopper is so called a "tethered stopper". The weakness line is torn when user unscrews the closure shell of the stopper or when user lifts the roof wall by tilting.

Known snap type stoppers have a roof which extends horizontally. Moreover, the roof comprises a tongue situated at the opposite edge relative to the hinge. Such tongue outwardly extends relative to the peripheral wall of the closure shell.

So the tongue forms an offset for an easier opening when the consumer pushes against such tongue from bottom to top in order to open the container.

Due to the horizontal tongue, such snap type stoppers are not as easy to open. The consumer must apply a vertical force up on the bottom of the tongue that is as high enough to break the bridges of the weakness line.

Moreover, the opening of the roof by lifting the tongue is more difficult because of the inner area engaged under the outer ring of the bottle neck. So when the consumer pushes the tongue, the inner area blocks against the outer ring.

Then, due to the plastic material of such stoppers, when pushing under the tongue, it happens that the tongue folds along a junction line with the top roof, which becomes harder to open.

Known snap type stoppers usually have one weakness line between the closure shell and the tamper band. When the bridges of this weakness line are intact, it is the proof that container was not previously opened or in other words a sign of tamper evidence.

Due to the snap type configuration of these stoppers, it is quite difficult for the consumer to note if the bridges were torn and so the weakness line broken by a previous opening.

SUMMARY OF INVENTION

An object of the present invention is to improve a snap type stopper with a tongue which allows said stopper to be easier to open. Such stopper comprises specific features, that can be combined, in order to change the orientation and the amount of the forces that are applied when pushing on the tongue.

Moreover, a snap type stopper comprises a closure shell with a sealing roof movable from a closure position to an opening position, and reversely. The roof may be separated upon opening but remains preferably connected with the closure shell through a hinge. So such hinge crosses the weakness line and maintains the roof attached to the closure shell when said roof is tilted by the consumer in the opening position.

Therefore, during container or bottle opening, the consumer upwardly pushes with a finger, especially the thumb, against an edge of the roof diametrically situated at the opposite of the hinge. So the roof is raised up and the bridges of the weakness line are torn apart from the closure shell, when the roof swings around the hinge. After opening, the roof remains attached to the closure shell the tamper band, which is secured on the container neck.

According to a first embodiment, the invention aims a stopper with a protruding tongue, extending upwardly relative to a plane surface of the roof. So the force to be applied is oriented in an inclined way, in the direction of the hinge. The opening is easier, compared to a vertical force of the known stoppers with a plane horizontal tongue.

According to a second embodiment, the invention describes a stopper with at least one thinner part of the peripheral wall situated under the tongue. Such reduced thickness of the material of the thinner part allows the closure shell to locally deforms and facilitates the passage of an inner bead of the closure shell against an outer clip ring laterally managed on the top of the bottle neck when opening. In some embodiments, the stopper according to the second embodiment comprises two separated thinner parts of the peripheral wall situated under the tongue. The thinner part(s) can be combined with the protruding tongue according the first embodiment.

According to a third embodiment, the invention describes a stopper with at least one rib linking the bottom of the tongue and the outer peripheral wall of the closure shell. Each rib extends vertically or almost vertically.

When the stopper comprises one rib, the rib is middle centered relative to the tongue. Preferably, when the stopper comprises two ribs, they are separated with a space which allow the consumer to introduce part of a finger, especially the thumb, between the two ribs, conferring a better opening grip with said finger. Moreover, each rib avoids the tongue to be deformed folded when opening by pushing. The rib(s) can be combined with the protruding tongue according to the first embodiment and/or the thinner part(s) of the second embodiment.

According to a fourth embodiment, the invention describes a stopper with a specific shaped weakness line between the closure shell and the tamper band, in order to manage part of the stopper which obviously shows to a consumer if the closure shell was already opened.

Such stopper comprises at least one toggle which is linked to the tamper band and to the closure shell through a first weakness line and a second weakness line. The first weakness line comprises at least one first bridge with a greater thickness than at least one second bridge of the second weakness line. So when opening the closure shell, the thicker first bridge(s) is more difficult to break than the second bridge(s). Moreover, the toggle comprises a reduced shaped junction with the closure shell or the tamper band. So the toggle rotates around the junction, due to the difference of forces applied between the first bridge and the second bridge. Once rotated, the junction has undergone a plastic deformation and the toggle remains in an inclined way in comparison with its original position, which is orientated to the first bridge with a bigger thickness. Then the consumer can immediately see if the toggle is in a normal unviolated orientation or in an inclined orientation, which means the container was already opened.

The toggle can be combined with the protruding tongue according to the first embodiment and/or the thinner part(s) of the second embodiment and/or the rib(s) of the third embodiment.

When the first, the second, the third and the fourth embodiments are combined, the invention aims a specific stopper accord to a preferred fifth embodiment.

BRIEF DESCRIPTION OF THE DRAWINGS

The invention can be better understood on reading the following description given merely by way of example and with reference to the accompanying drawings, in which.

DESCRIPTION OF EMBODIMENTS

Figure 1:
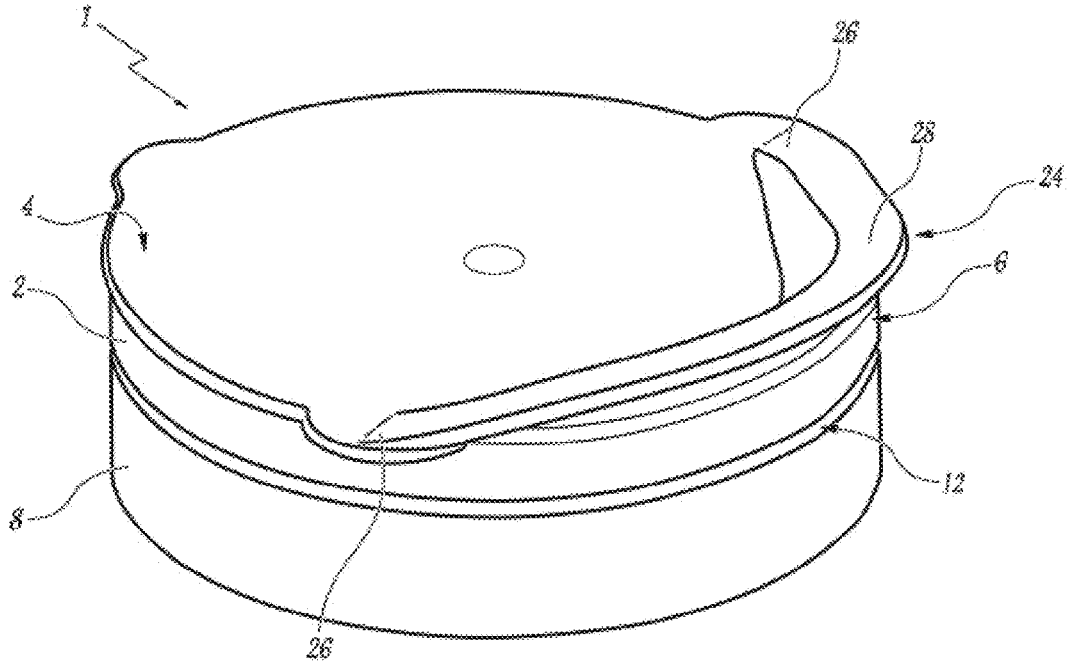
FIG. 1 is a perspective global view of a stopper according to a first embodiment, especially showing the protruding tongue above a part of the roof.
Figure 2:
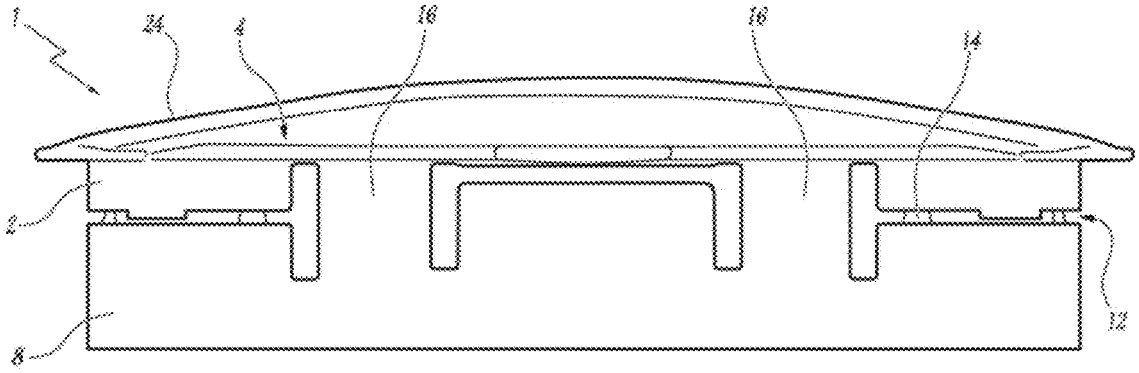
FIG. 2 is a rear view of the first embodiment, especially showing the hinge linking the closure shell and to the roof.
Figure 3:
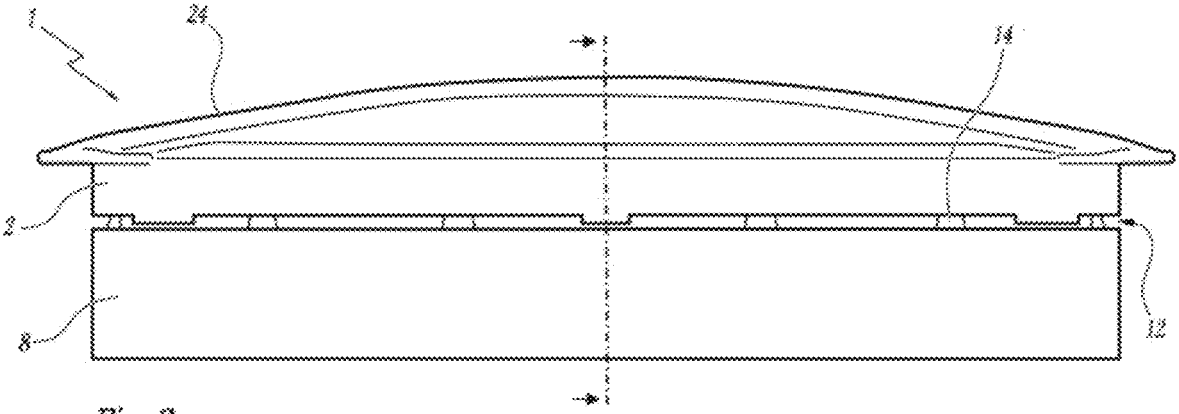
FIG. 3 is a front view of the first embodiment.

The invention relates to a stopper 1. Such stopper 1 is made of a plastic material, essentially made during a molding operation. Part of the stopper 1 can eventually be made through at least one cutting step after molding.

The stopper 1 has a body which has a global tubular or cylindrical shape. The stopper 1 comprises a closure shell 2 with a roof wall 4. The roof wall 4 is located at the top of the closure shell 2 and globally has a plane horizontal surface. The closure shell also comprises a peripheral wall 6. Such peripheral wall 6 vertically extends around the roof wall 4.

The stopper 1 also comprises a tamper band (also called "tamper evident ring"). The tamper band 8 is located under the closure shell 2 and is designed to be secured on a bottle neck 10. Therefore, the tamper band 8 can comprise inner area(s) shaped to be engaged in force with corresponding outer ring(s) managed of the bottle neck when sealing the stopper 1 on the bottle neck 10.

The stopper 1 further comprises a first weakness line 12 with first bridges 14. The first bridges 14 separably link the bottom edge of the closure shell 2 to—the top edge of the tamper band 8. The first bridges 14 are distributed around the stopper 1, regularly or not. The first bridges 14 are made when molding the stopper or after molding through a cutting step.

When opening, the first bridges 14 of the first weakness line 12 are torn apart from the tamper band 8 secured on the bottle neck 10. The closure shell 2 is also separated from the tamper band 8.

The stopper 1 is a snap type stopper. The stopper 1 comprises at least one hinge 16. Preferably, the stopper comprises two hinges 16, which are laterally spaced from each other. The hinge 16 extends through the first weakness line 12. The hinge 16 pivotably links the closure shell 2 and the tamper band 8.

When opening, the closure shell 2 and its roof wall 4 pivotably turn around the hinge 16 and remain attached to the tamper band 8 and the container, so that they can be positioned back in place to close and seal back the container.

As such, the bottle neck 10 comprises an outer clip ring 18. The outer clip ring 18 is located at the top of the bottle neck 10 and outwardly and laterally extends relative to the outer surface of the neck 10.

The closure shell 2 comprises an inner bead 20. The inner bead 20 is located to almost face the outer clip ring 18. So when closing and sealing the bottle neck 10, the inner bead 20 must go through the outer clips ring 18 and the closure shell 2 is clipped on the bottle neck 10 thanks to the cooperation of the bead 20 against the bottom of the outer clip ring 18.

Moreover the closure shell 2 comprises an inner lip 22 shaped to allow the closure shell 2 to be tightly sealed on the top inner edge of the bottle neck 10. Such lip 22 is especially visible on FIGS. 5 and 6.

The stopper 1 further comprises a tongue 24. The tongue 24 is diametrically situated at the opposite of the hinge 16. The tongue 24 outwardly extends relative to the peripheral wall 6 of the closure shell 2.

The tongue 24 is a fulcrum where the consumer can apply pressure (e.g., using a finger, like the thumb) to push downward when opening. The tongue 24 can also be pressed from top to bottom when closing, to seal back the bottle neck 10 by exerting the necessary force for the passage of the bead 20 over the outer clip ring 18 and also tightly engage the lip 22 into the bottle neck 10.

According to a first embodiment, such as shown in the FIGS. 1 to 8, the tongue 24 is upwardly protruding relative to the roof wall 4. In other words, the tongue 24 partially extends above the top surface of the closure shell 2. Such high difference between an end of the tongue 24 and the roof wall 4 creates an almost vertical offset which allows the consumer to put a finger, especially the thumb, between and inside this created space. So at the beginning of opening, the force applied to push from bottom to top on the tongue 24 is not anymore vertical but oriented in an inclined way, such as shown by an arrow in FIGS. 6 and 7. The first step of opening for the bead 20 to go over the clip ring 18 is easier with this inclined push force.

In some embodiments, the tongue 24 is made during the molding process of fabrication of the stopper 1, so the tongue 24 is integral with the body of the stopper 1.

Figure 8:
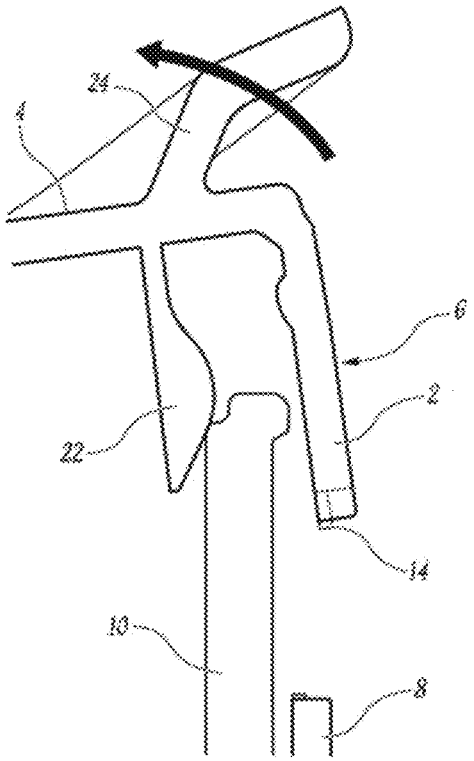
FIG. 8 is a similar cross section view of FIG. 7, especially showing the rotation of the closure shell at a further step of opening, once the lip and the bead are released from the bottle neck.
Figure 9:
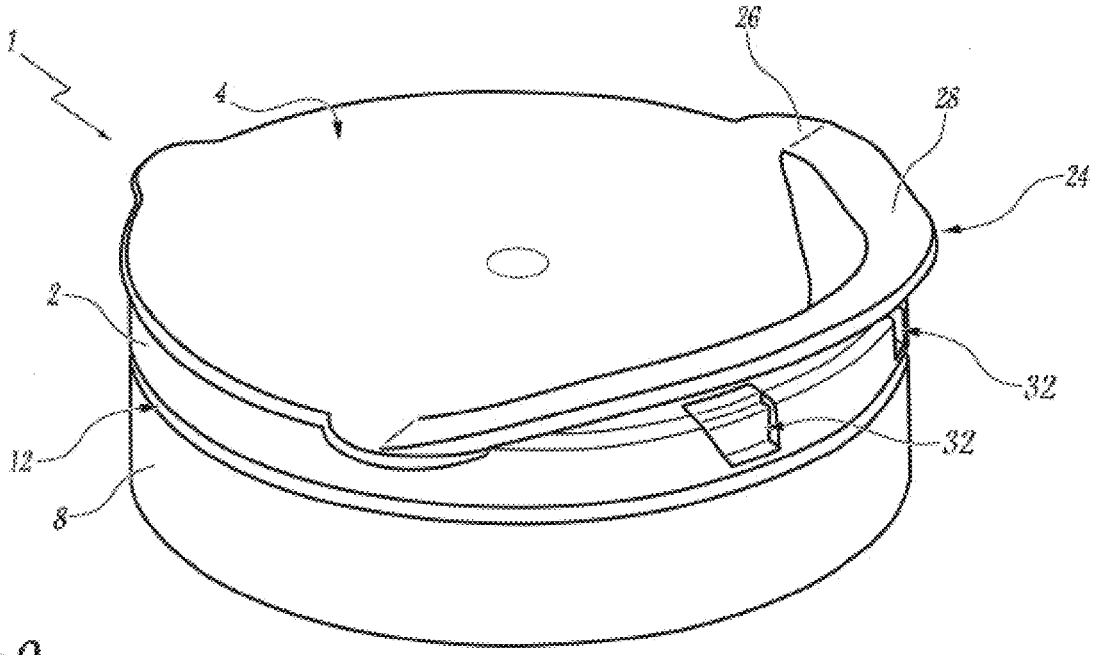
FIG. 9 is a global perspective view of a stopper according to a second embodiment, combined with the protruding tongue of the first embodiment, especially showing two thinner parts of the peripheral wall of the closure shell.

Then once the bead 20 crossed over the clip ring 18, the force applied on the tongue 24 results in a rotation around the hinge 16, such as shown in FIG. 8.

According to another first embodiment, the tongue 24 is shaped like a semi-circle arc, such as shown in FIG. 1.

Figure 4:
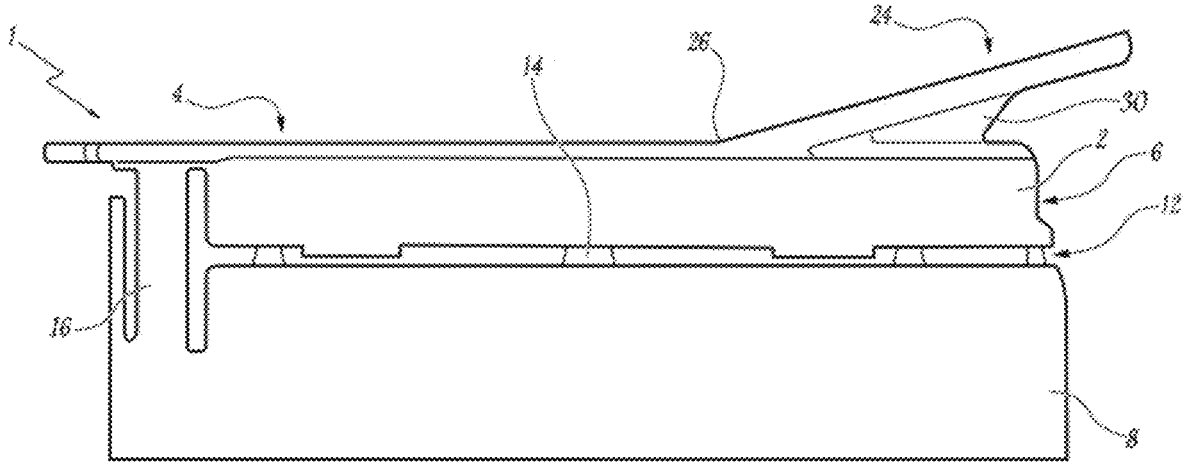
FIG. 4 is a lateral view of the first embodiment.
Figure 5:
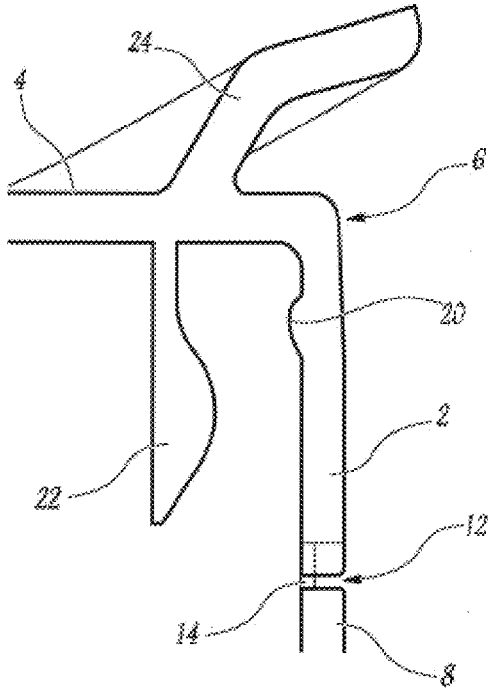
FIG. 5 is a cross section view of FIG. 3, along the dotted axis, showing a part of the stopper of the first embodiment.
Figure 6:
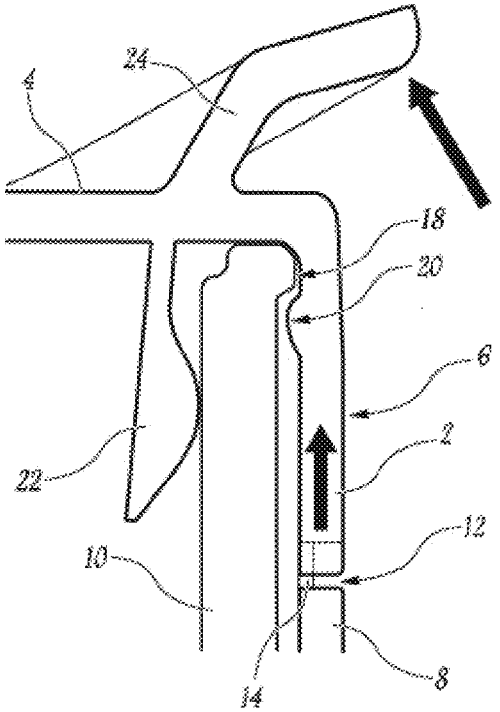
FIG. 6 is a similar cross section view of FIG. 5, wherein the stopper is engaged on a bottle neck, especially showing the direction of the forces applied at a beginning step of opening when the consumer pushes on the tongue.
Figure 7:
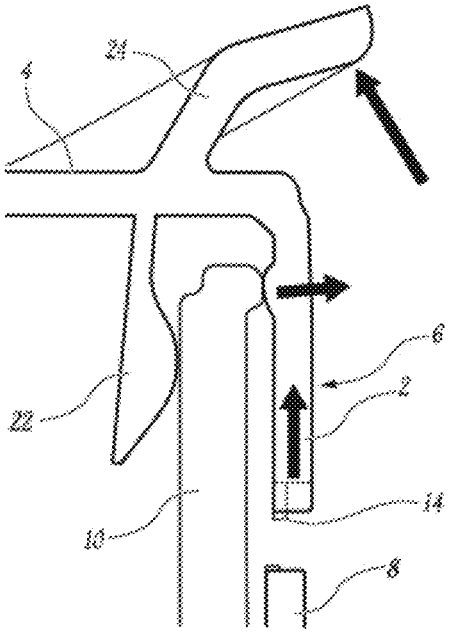
FIG. 7 is a similar cross section view of FIG. 6, especially showing a deformation when the bead crosses the clip ring at a following step of opening.

According to another first embodiment, the tongue 24 is oriented in an inclined way relative to a horizontal outer surface of the roof wall 4, such as shown in FIGS. 4 and 5.

According to another first embodiment, the tongue 24 comprises two ends 26. The two ends 26 are linked to the outer surface of the roof wall 4. According to another first embodiment, the tongue 24 comprises a band 28. The band 28 extends between the two ends 26.

According to another first embodiment, the tongue 24 comprises an inner wall 30. The inner wall extends between the two ends 26 and under the band 28. So the inner wall 30 reinforces the structure of the tongue 24 and avoids the tongue 24 to rotate around its ends 26 when pushing under the band 28.

Figure 15:
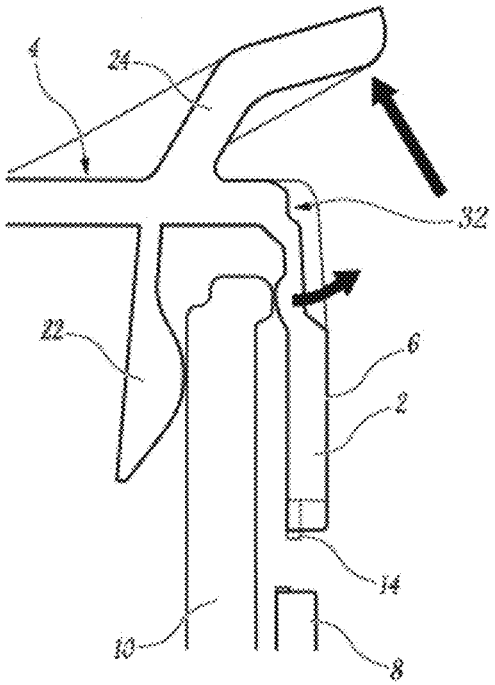
FIG. 15 is a cross section view similar to FIG. 14, wherein the bead is pulled away from the clip ring thanks to the thinner part to facilitate beginning of opening.
Figure 16:
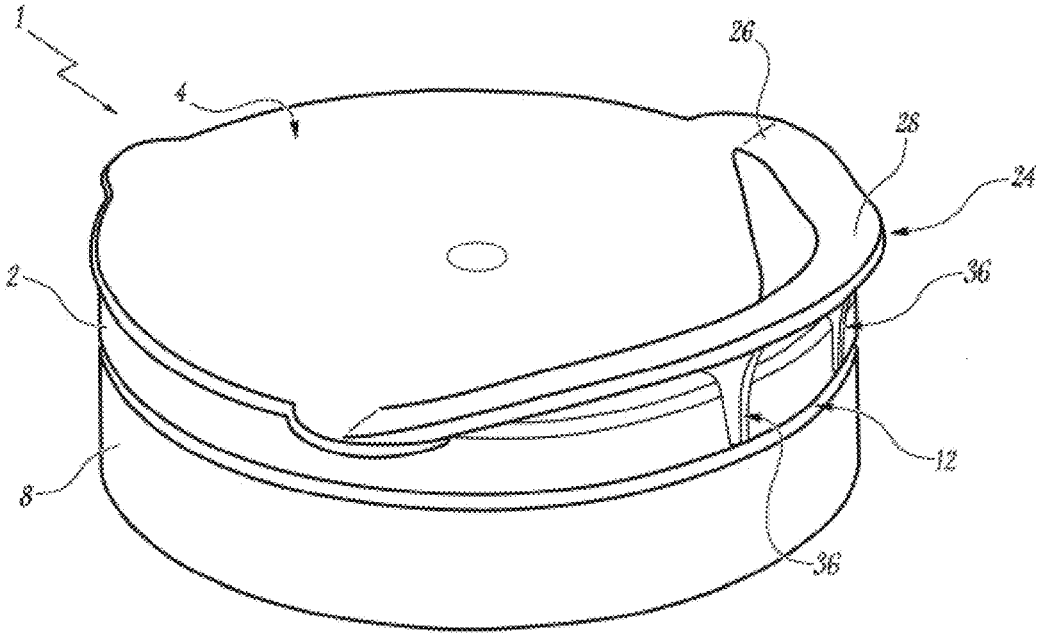
FIG. 16 is a global perspective view of a stopper according to a third embodiment, combined with the protruding tongue of the first embodiment, especially showing two ribs linked to the protruding tongue.

According to a second embodiment, such as shown in the FIGS. 9 to 15, the closure shell 2 comprises at least one portion 32 of the peripheral wall 6 situated under the tongue 24 and the at least one portion 32 is thinner than the peripheral wall 6. Such thinner portion 32 allows a local deformation of the closure shell 2, when the bead 20 crosses the clip ring 18, such as shown in FIG. 15. This results in less resistance and the force the end consumer must apply is lowered in order at the beginning of opening.

Figure 10:
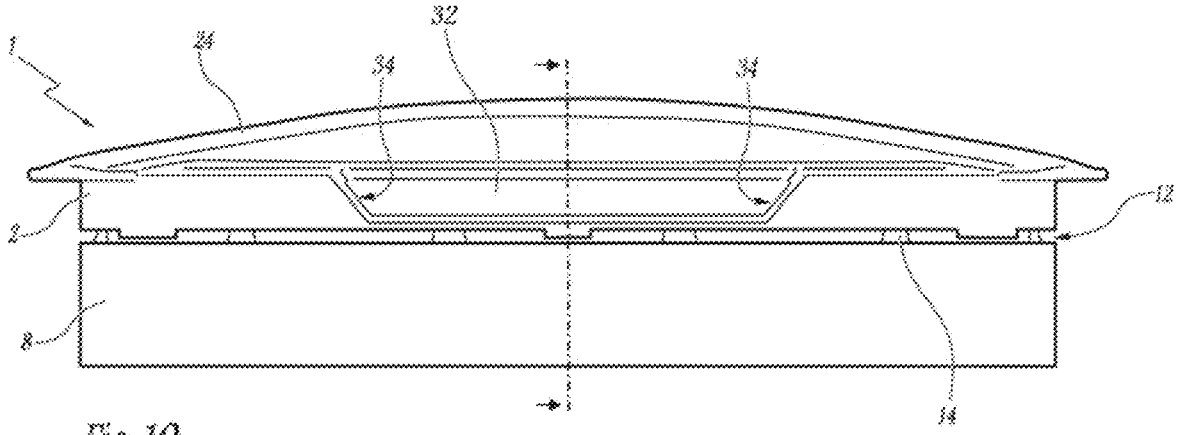
FIG. 10 is a front view of the second embodiment, wherein the closure shell comprises one thinner part.

According to another second embodiment, the closure shell 2 comprises only one thinner portion 32 under the tongue 24, such as shown in FIG. 10.

Figure 11:
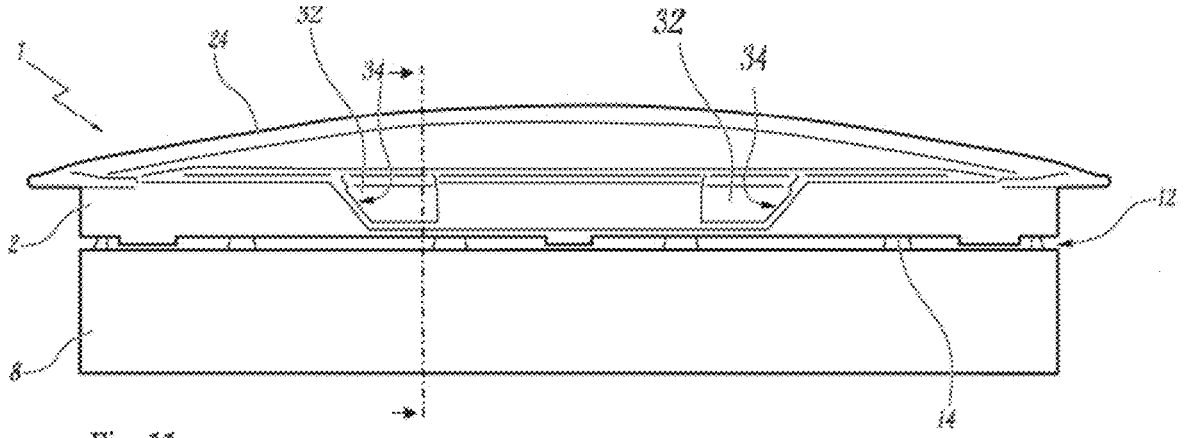
FIG. 11 is a front view of the second embodiment, wherein the closure shell comprises two separated thinner parts.
Figure 12:
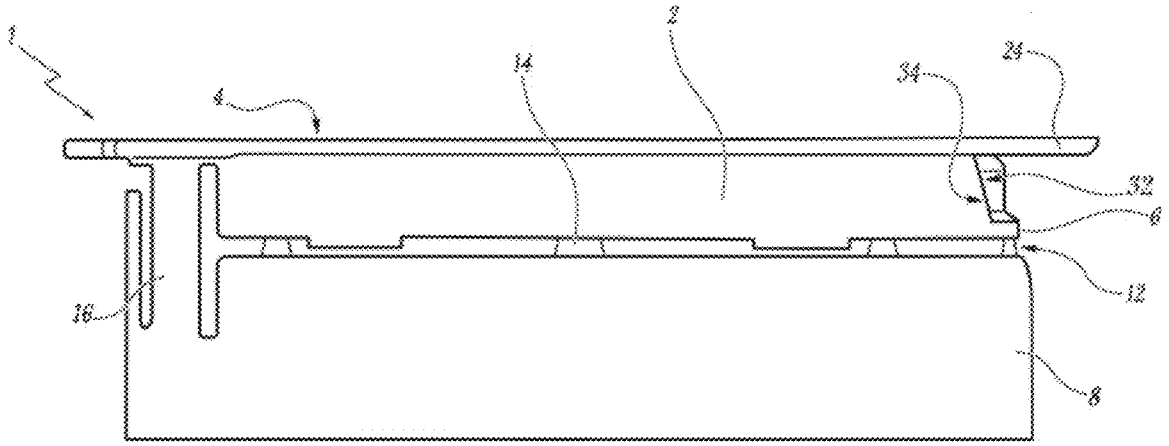
FIG. 12 is a lateral view of the second embodiment, wherein the tongue is in a horizontal plane.
Figure 13:
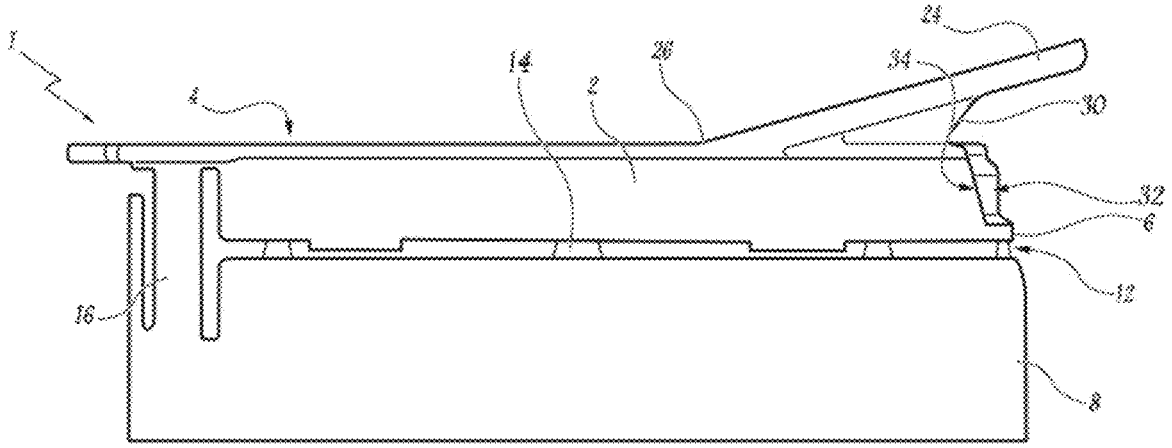
FIG. 13 is a lateral view of the second embodiment, combined with the protruding tongue of the first embodiment.
Figure 14:
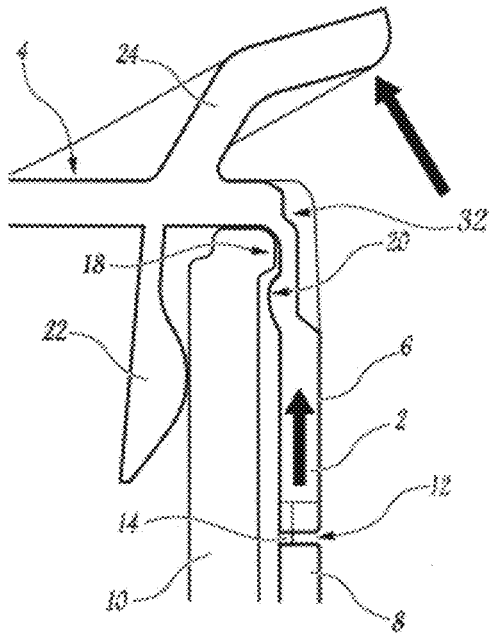
FIG. 14 is a cross section view of FIG. 8, along the dotted axis, wherein the stopper is engaged on a bottle neck, especially showing the direction of the forces applied when the consumer pushes on the tongue.

According to—another second embodiment, as shown in FIG. 11, the closure shell 2 comprises two thinner portions 32 of the peripheral wall 6. So the two thinner portions 32 are spaced apart from each other. In other words, between the two thinner portions 32, the peripheral wall 6 has its normal thickness.

According to another second embodiment, as previously mentioned, the closure shell 2 comprises at least one inner bead 20, the inner bead being shaped to cooperate with an outer clip ring 18 of the bottle neck 10. So the at least one thinner portion 32 extends at least upwardly relative to the at least one inner bead 20. In other words, the portion 32 are globally located above the bead 20, to allow a flexion deformation to facilitate the bead 20 to go over the clip ring 18. Indeed a part of the thinner portion 32 can also be situated below the bead 20.

According to another second embodiment, each thinner portion 32 comprises two lateral walls 34. Moreover at least one the two lateral walls 34 extends in an inclined divergent way from bottom to top. So the thinner portion 32 has a trapezoidal shape. Such inclined lateral wall(s) 34 avoid the risk of tearing and orientates the push force to the center from top to bottom.

As previously mentioned, the second embodiment can be combined with each of the features of the first embodiment. So the stopper 1 further comprises the tongue 24 upwardly protruding relative to the roof wall 4.

According to a third embodiment, such as shown in the FIGS. 16 to 20, the closure shell 2 comprises a least one rib 36. Each rib 36 is linked to a bottom face of the tongue 24 and the peripheral wall 6. So each rib 36 reinforces the tongue 24 to avoid any deformation when pushing on the tongue 24 from bottom to top at opening.

Figure 17:
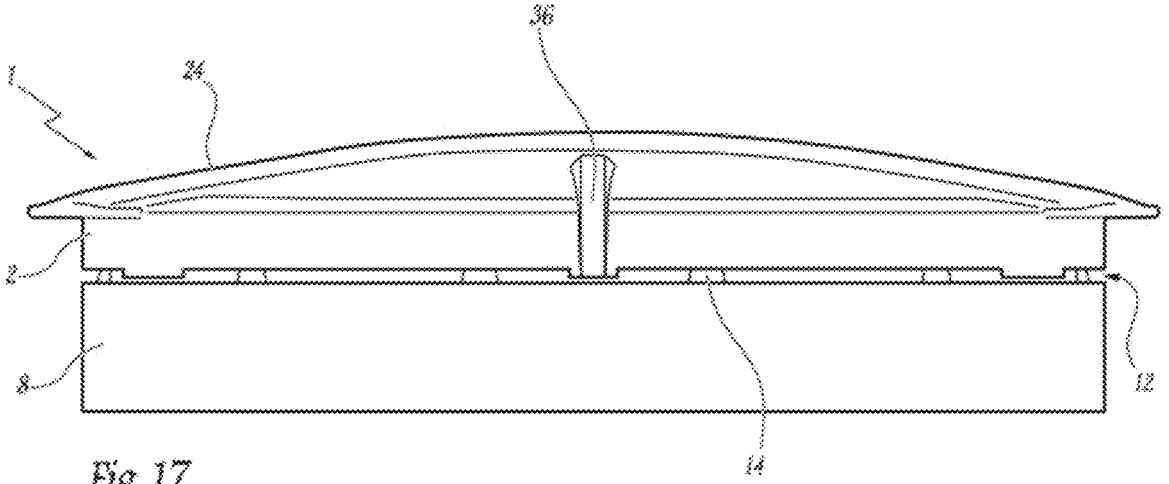
FIG. 17 is a front view of the third embodiment, wherein the closure shell comprises one rib.

According to another third embodiment, as shown in FIG. 17, the closure shell 2 comprises only one rib 36. The unique rib 36 is middle centered.

Figure 18:
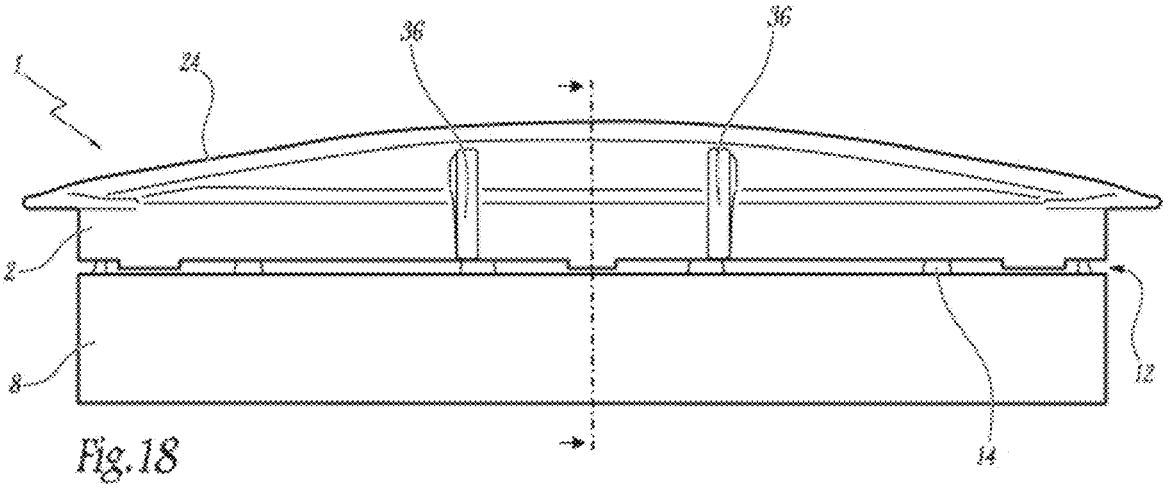
FIG. 18 is a front view of the third embodiment, wherein the closure shell comprises two ribs.

According to another third embodiment, as shown in FIG. 18, the closure shell 2 comprises two ribs 36. Moreover the ribs 36 are spaced apart from each other. So the two ribs 36 are symmetrically located relative to a middle axis, shown in dotted line in FIG. 18.

Figure 19:
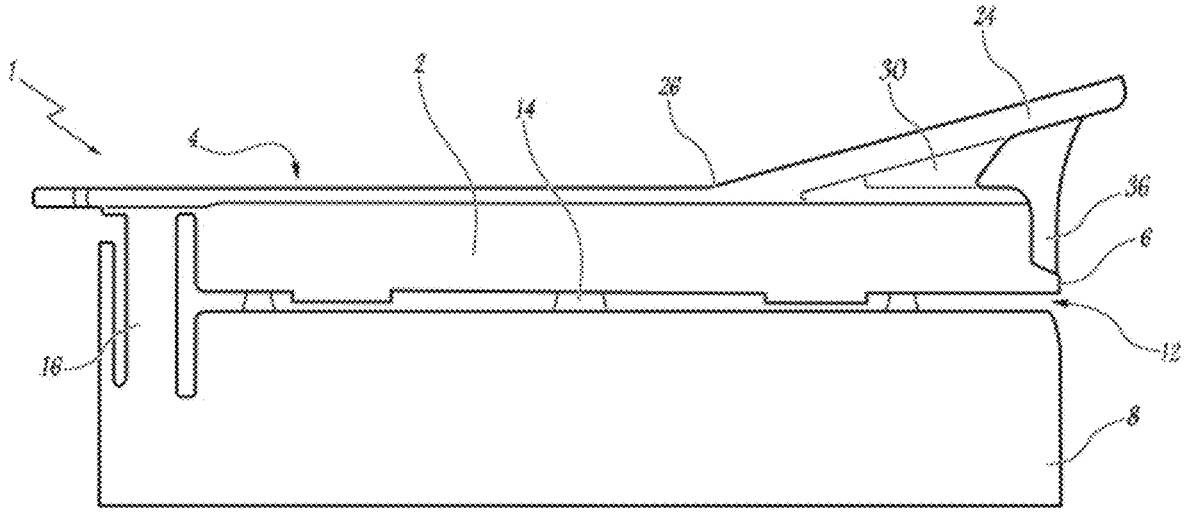
FIG. 19 is a lateral view of the third embodiment, combined with the protruding tongue of the first embodiment.
Figure 20:
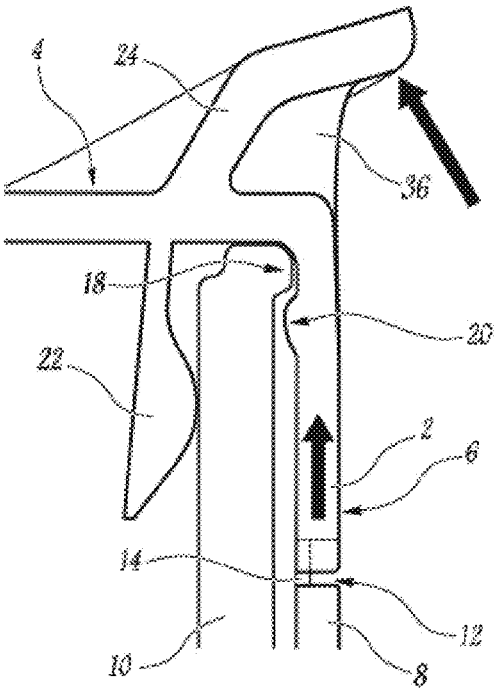
FIG. 20 a cross section view of FIG. 5, along the dotted axis, wherein the stopper is engaged on a bottle neck, especially showing the direction of the forces applied when the consumer pushes on the tongue for opening and the rib maintaining the tongue.
Figure 21:
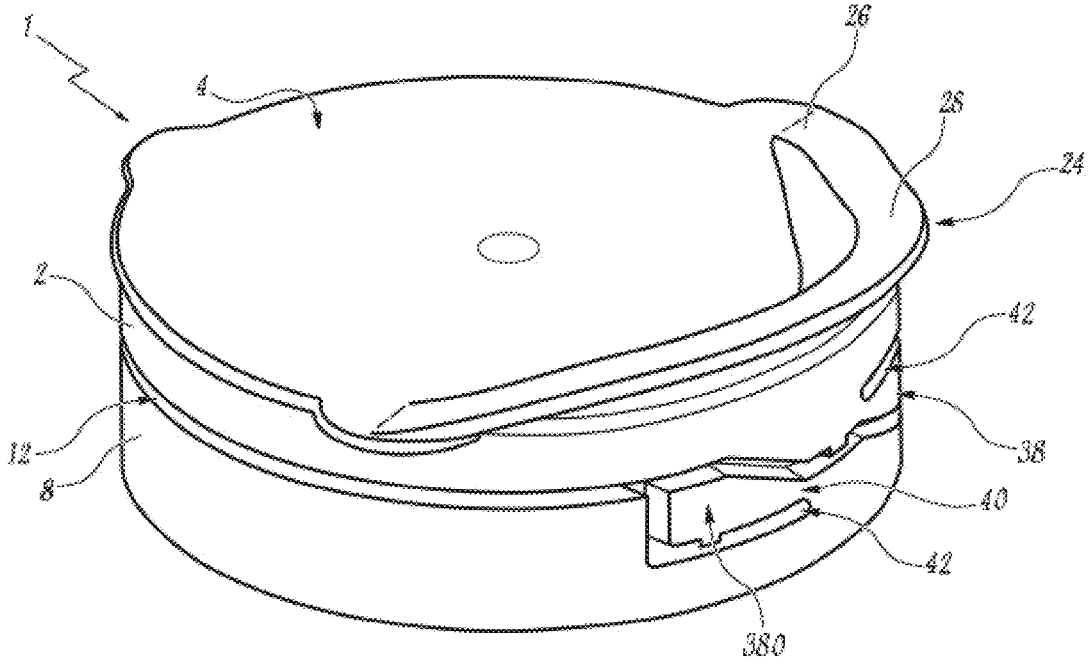
FIG. 21 is a global perspective view of a stopper according to a fourth embodiment, combined with the protruding tongue of the first embodiment, especially showing a stopper with two toggles.
Figure 22:
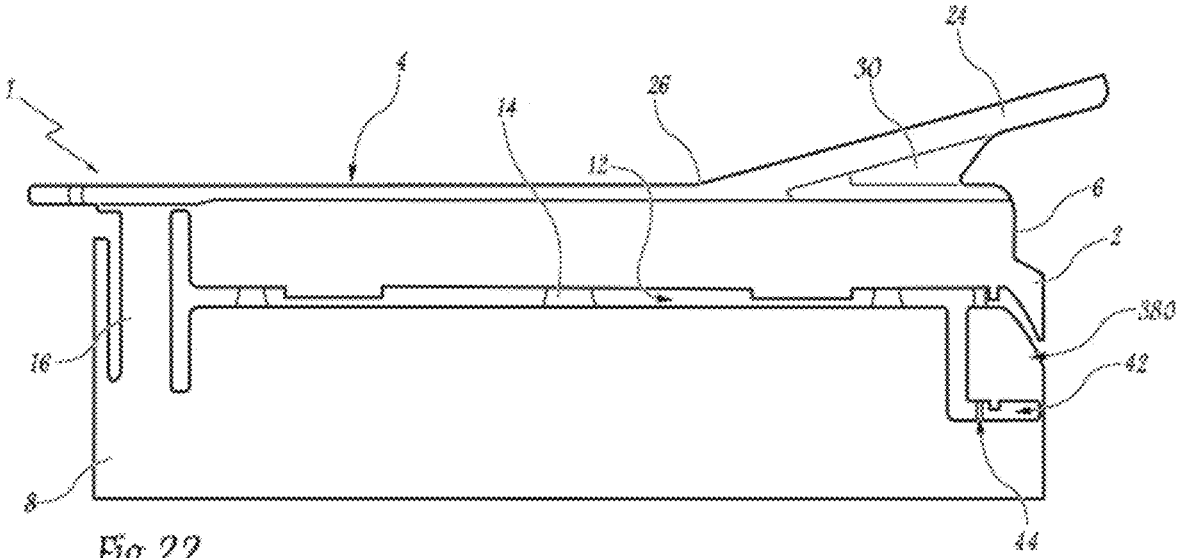
FIG. 22 is a lateral view of FIG. 21.

According to another embodiment, each rib 36 extends vertically, such as visible in FIGS. 17 and 18. According to another embodiment, not shown, each rib 36 can be inclined relative to the vertical axis. Preferably, two separated ribs 36 can be oriented in an inclined convergent way from top to bottom, almost in a V shape. According to another embodiment, shown in FIGS. 19 and 20, each rib 36 comprises an outer concave curved shape, such as shown in FIG. 19.

As previously mentioned, the third embodiment can be combined with each of the features of the first embodiment and/or the second embodiment. So the stopper 1 further comprises the tongue 24 upwardly protruding relative to the roof wall 4 and/or the closure shell 2 comprises the thinner portion(s) 32.

According to a fourth embodiment, such as shown in the FIGS. 21 to 25, the closure shell 2 or the tamper band 8 comprises at least one toggle 38.

Figure 23:
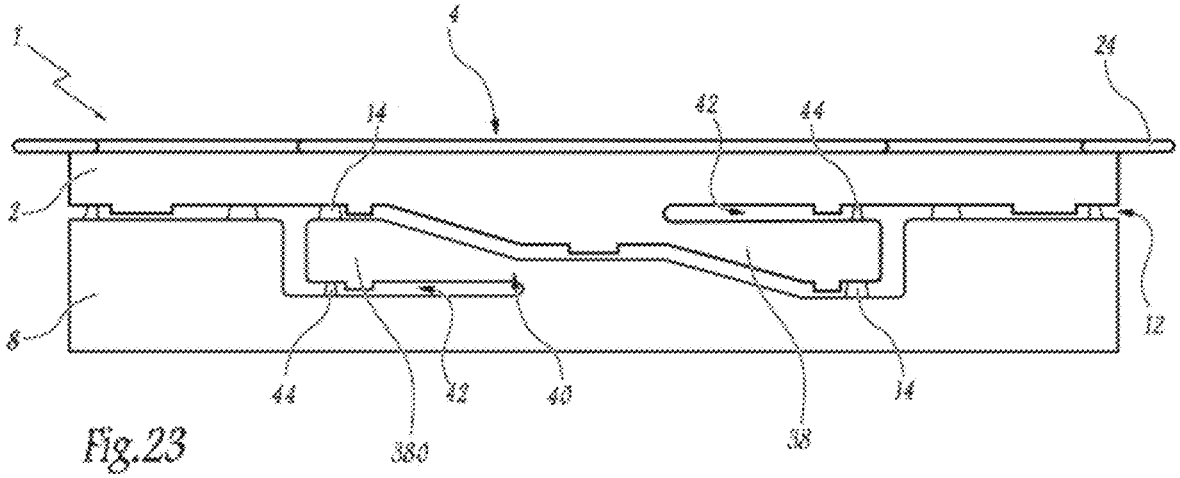
FIG. 23 is a front view of the fourth embodiment, wherein the closure shell comprises a horizontal or plane tongue.
Figure 24:
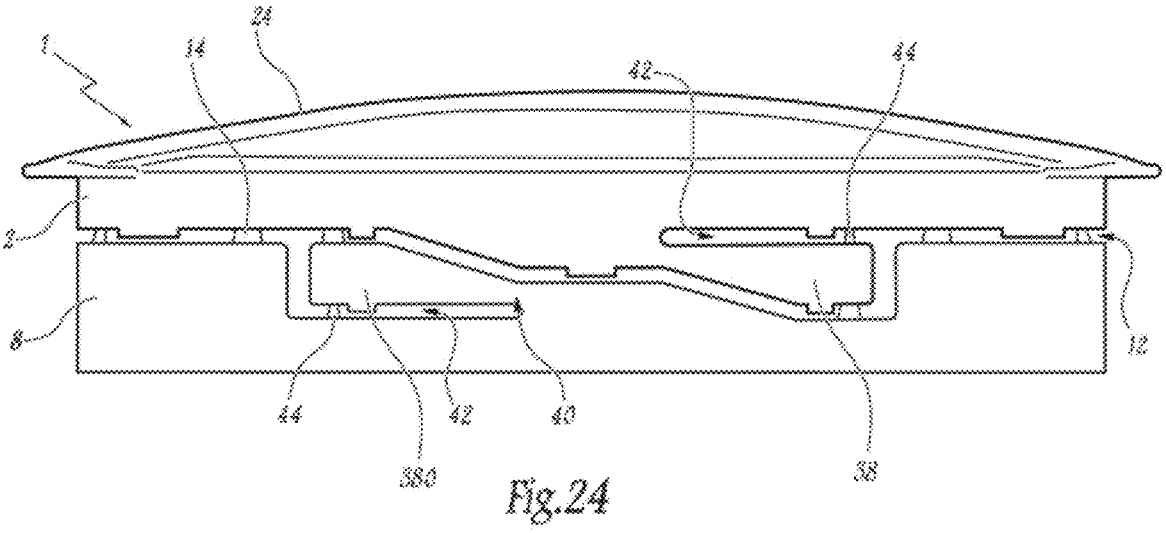
FIG. 24 is a front view of the fourth embodiment, wherein the closure shell comprises a protruding tongue, especially showing two toggles in a closed sealed position.
Figure 25:
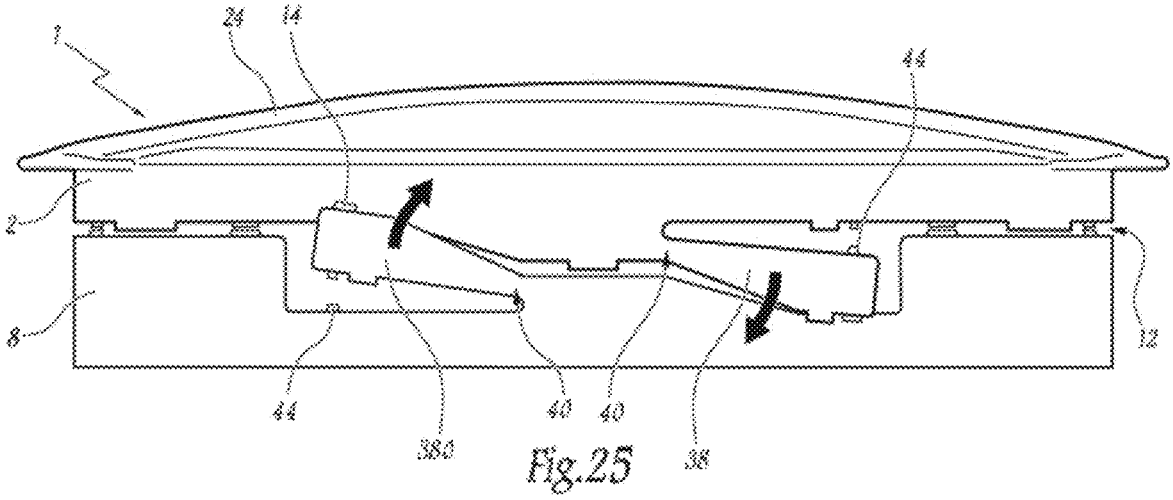
FIG. 25 is a similar front view of the fourth embodiment, especially showing the two turned toggles after an opening.
Figure 26:
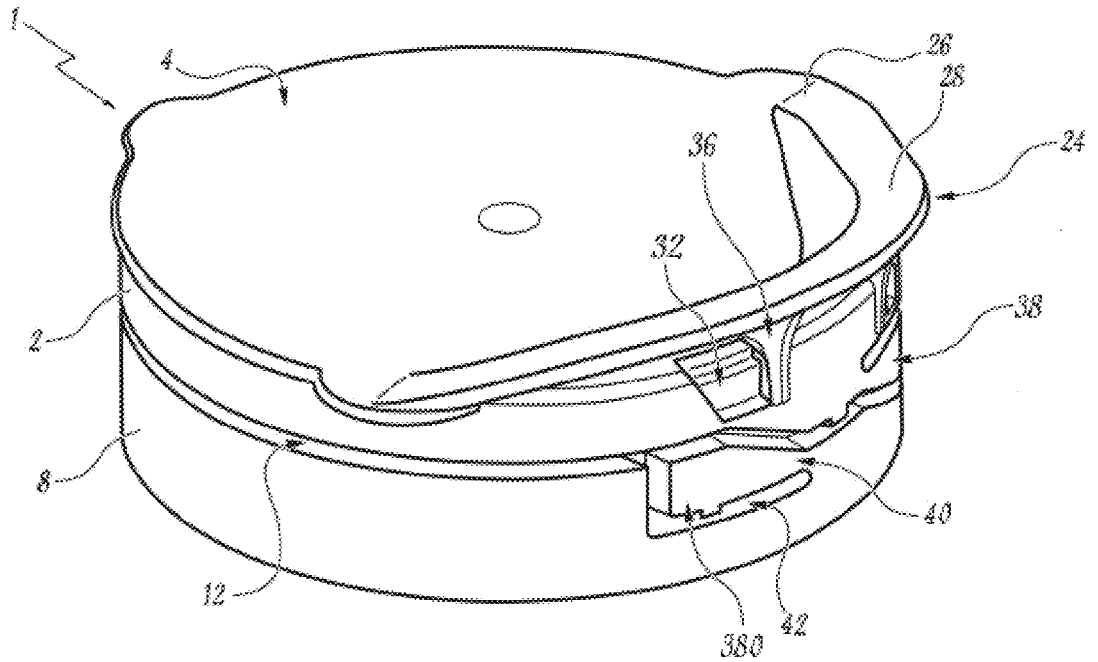
FIG. 26 is a global perspective view of a stopper according to a fifth embodiment, combined with the first, second, third and fourth embodiments, wherein the closure shell comprises two thinner walls and a protruding tongue linked with two ribs, and also two toggles.
Figure 27:
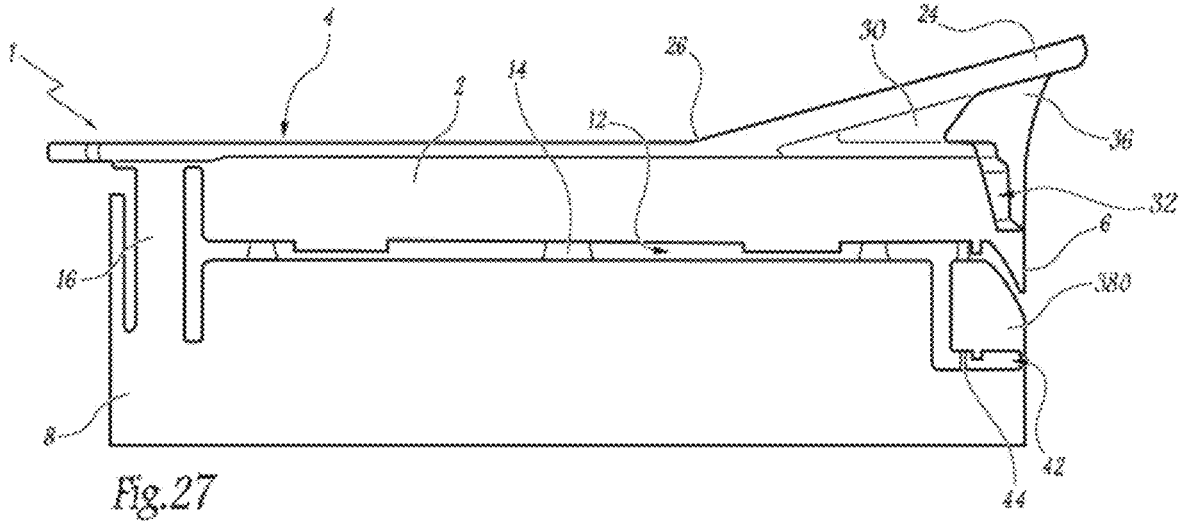
FIG. 27 is a lateral view of FIG. 23.
Figure 28:
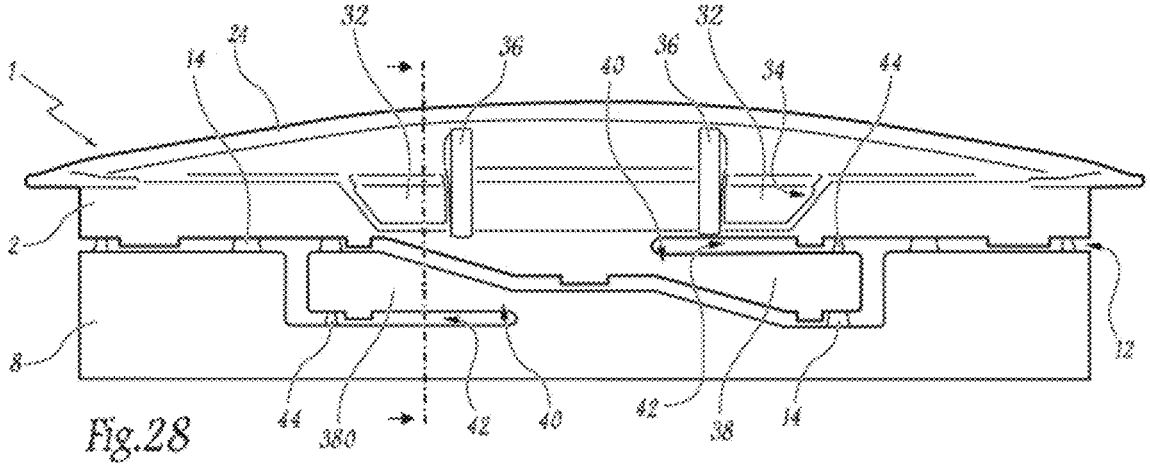
FIG. 28 is a front view of FIG. 23.
Figure 29:
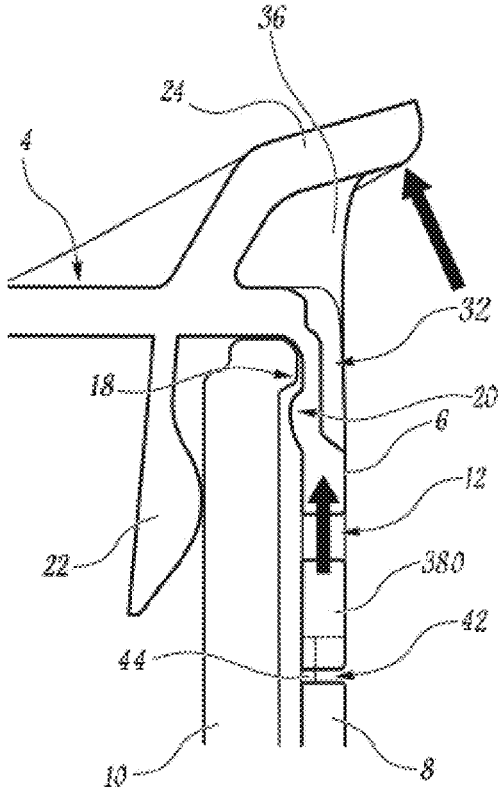
FIG. 29 is a cross section view of FIG. 28, along the dotted axis, wherein the stopper is engaged on a bottle neck, especially showing the direction of the forces applied when the consumer pushes on the tongue at a first step of opening.
Figure 30:
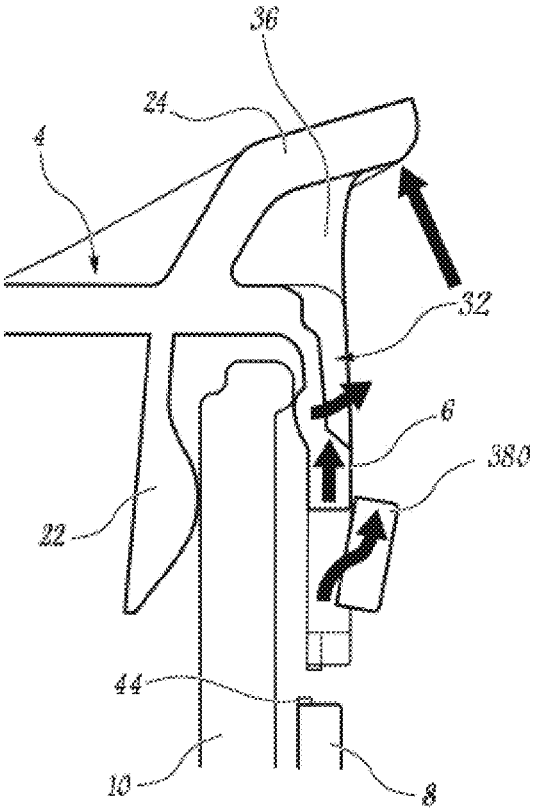
FIG. 30. is a cross section view of FIG. 29, at a following step of opening, especially showing the forces applied when the bead crosses the clip ring of the bottle neck, and also the outward movement of one toggle.

According to another fourth preferred embodiment, such as especially visible in FIGS. 23 to 25, the closure shell 2 comprises one toggle 38 and the tamper band 8 comprises another toggle 380. So there is a right toggle 38 linked to the closure shell 2 and there is another left toggle 380 linked to the tamper band 8, or vice versa. Thus, the toggle 38 is top linked and another toggle 380 is bottom linked, or vice versa. Each toggle 38 is a visual element to show to the consumer that the stopper 1 was not previously opened. Therefore, each toggle 38 rotates when first opening and stay in a inclined way after first opening, so the consumer can easily see if the stopper 1 was tampered or not.

Moreover, each toggle 38 is linked to the closure shell 2 or the tamper band 8 through a junction point 40. The junction point 40 is a small part of the toggles 38, 380, so the toggle 38 can rotate around said junction point 40.

In order to allow the toggle rotation, the stopper 1 further comprising a second weakness line 42. The second weakness line 42 extends from the junction point 40 to the first weakness line 12, So the first weakness line 12 and the second weakness line 42 surround the toggle 38, 380, except for the junction point 40.

Moreover the second weakness line 42 comprises at least one second bridge 44. The second bridge 44 can have a lesser thickness than one of the first bridges 14 of the first weakness line 12 located vertically aligned with the at least one second bridge 44. In other words, a second bridge 44 is thinner than a first bridge 14. Inversely the second bridge 44 can have a greater thickness than one of the first bridges 14 of the first weakness line 12 located vertically aligned with the at least one second bridge 44.

So when the closure shell 2 is pushed upward to open the stopper 1, the bigger first bridge 14 remains until the thinner second bridge 44 is torn. Then the first bridge 14, which is still intact, causes the rotation of the toggle 38 until said bigger first bridge 14 is torn. Thus, the second weakness line 42 breaks before the first weakness line 12, so that each toggle 38,380 rotates after the breaking of the second weakness line 42 and before the breaking of the first weakness line 12. One example of clockwise rotation of the toggles 38 is shown in FIG. 25. If the second bridge 44 is bigger than the first bridge 14, the toggle rotation would be counter-clockwise.

According to another fourth embodiment, the toggle 38 and another toggle 380 are located under the tongue 24. Thus, this location of toggles 38 ensures the breakings of the second bridge 44 then the first bridge 14 before the other bridges 14 of the first weakness line 12.

According to another fourth embodiment, the toggle 38 and another toggle 380 are symmetrically located from either side of a median vertical plane of the stopper 1. such location is especially shown in FIGS. 23 and 24.

According to another fourth embodiment, the toggle 38 and another toggle 380 are symmetrical relative to a center point of the first weakness line 12. According to another fourth embodiment, the first weakness line 12 extends on an incline above the toggle 38 and under another toggle 380. So each toggle 38 has almost a trapezoidal shape.

As previously mentioned, the fourth embodiment can be combined with each of the features of the first embodiment and/or the second embodiment and/or of the third embodiment. So the stopper 1 further comprises the tongue 24 upwardly protruding relative to the roof wall 4 and/or the closure shell 2 comprises the thinner portion(s) 32 and/or the closure shell 2 comprises a least one rib 36.

According to a fifth embodiment, as shown in FIGS. 26 to 30, the stopper 1 combines all the features of the afore mentioned embodiments. Such combined protruding tongue 24 with two ribs 36 and two thinner portions 32, and also two toggles 38,380 give special dedicated forces for an easier opening of the stopper 1 by the consumer.

The invention claimed is:

1. A snap type plastic stopper comprising:

a closure shell with a roof wall and a tamper band to be secured on a bottle neck;

a first weakness line with first bridges, wherein the first bridges separably link a bottom edge of the closure shell and a top edge of the tamper band;

at least one hinge which extends through the first weakness line, wherein the hinge pivotably links the closure shell and the tamper band; and a tongue which is diametrically situated at the opposite of the hinge, wherein the tongue outwardly extends relative to a peripheral wall of the closure shell and wherein the tongue extends at least partially above a top surface of the closure shell; wherein:

the closure shell or the tamper band comprises at least one toggle, the toggle being linked to the closure shell or the tamper band through a junction point wherein the toggle rotates about the junction point upon first opening;

the stopper further comprising a second weakness line, the second weakness line extending from the junction point to the first weakness line, the second weakness line comprising at least one second bridge, the second bridge having a less thickness than one of the first bridges of the first weakness line located vertically aligned with the at least one second bridge; or the second bridge having a more thickness than one of the first bridges of the first weakness line located vertically aligned with the at least one second bridge.

2. The snap type plastic stopper according to claim 1, wherein the closure shell comprises one toggle and the tamper band comprises another toggle.

3. The snap type plastic stopper according to claim 2, wherein the toggle and the another toggle are located under the tongue.

4. The snap type plastic stopper according to claim 2, wherein the toggle and the another toggle are symmetrically located from either side of a median vertical plane of the stopper.

5. The snap type plastic stopper according to claim 2, wherein the toggle and the another toggle are symmetrical relative to a center point of the first weakness line.

6. The snap type plastic stopper according to claim 4, wherein the first weakness line inclinedly extends above the toggle and under the another toggle.

7. The snap type plastic stopper according to claim 1, wherein the tongue is upwardly protruding relative to the roof wall.

8. The snap type plastic stopper according to claim 1, wherein the closure shell further comprises at least one portion of the peripheral wall situated under the tongue, and the at least one portion is thinner than the peripheral wall.

9. The snap type plastic stopper according to claim 1, wherein the closure shell comprises at least one rib; and each rib is linked to a bottom face of the tongue and the peripheral wall.

10. The snap type plastic stopper according to claim 1, wherein the tongue is upwardly protruding relative to the roof wall;

at least one portion of the peripheral wall situated under the tongue, and the at least one portion is thinner than the peripheral wall.

11. The snap type plastic stopper according to claim 1, wherein the tongue is upwardly protruding relative to the roof wall;

at least one portion of the peripheral wall situated under the tongue, the at least one portion is thinner than the peripheral wall;

the closure shell comprises a least one rib; and each rib is linked to a bottom face of the tongue and the peripheral wall.

12. The snap type plastic stopper according to claim 1, wherein the closure shell further comprises at least one portion of the peripheral wall situated under the tongue, the at least one portion is thinner than the peripheral wall; and at least one rib, each rib is linked to a bottom face of the tongue and the peripheral wall.

13. A snap type plastic stopper comprising:

a closure shell with a roof wall and a tamper band to be secured on a bottle neck;

a first weakness line with first bridges, wherein the first bridges separably link a bottom edge of the closure shell and a top edge of the tamper band;

at least one hinge which extends through the first weakness line, wherein the hinge pivotably links the closure shell and the tamper band;

a tongue which is diametrically situated at the opposite of the hinge, wherein the tongue outwardly extends relative to a peripheral wall of the closure shell; and wherein the tongue is upwardly angled relative to a plane of the roof and wherein the tongue extends at least partially above a top surface of the roof.

14. The snap type plastic stopper according to claim 13, wherein the tongue is shaped like a semicircle arc.

15. The snap type plastic stopper according to claim 14, wherein the tongue is oriented in an inclined way relative to a horizontal outer surface of the roof wall.

16. The snap type plastic stopper according to claim 15, wherein the tongue comprises two ends; and the two ends being linked to the outer surface of the roof wall.

17. The snap type plastic stopper according to claim 16, wherein the tongue comprises a band; and the band extending between the two ends.

18. The snap type plastic stopper according to claim 17, wherein the tongue comprises an inner wall; and the inner wall extending between the two ends and under the band.

* * * * *